US006186101B1

(12) United States Patent
Kreuter

(10) Patent No.: US 6,186,101 B1
(45) Date of Patent: Feb. 13, 2001

(54) DEVICE FOR ACTIVATING AND DEACTIVATING A LOAD CHANGE VALVE OF AN INTERNAL COMBUSTION ENGINE

(75) Inventor: Peter Kreuter, Aachen (DE)

(73) Assignee: META Motoren - und Energie-Technik GmbH (DE)

( * ) Notice: Under 35 U.S.C. 154(b), the term of this patent shall be extended for 0 days.

(21) Appl. No.: 09/347,578

(22) Filed: Jun. 29, 1999

(30) Foreign Application Priority Data

Jun. 29, 1998 (DE) ..... 198 28 945

(51) Int. Cl.[7] ..... F01L 1/34

(52) U.S. Cl. ..... 123/90.15; 123/90.16; 123/90.17

(58) Field of Search ..... 123/90.15, 90.22, 123/90.35, 90.5, 90.55, 90.16, 90.17

(56) References Cited

U.S. PATENT DOCUMENTS 5,261,363 * 11/1993 Speil et al. ..... 123/90.22
5,501,187 * 3/1996 Speil et al. ..... 123/90.22
5,503,121 * 4/1996 Speil et al. ..... 123/90.22
5,829,400 * 11/1998 Speil et al. ..... 123/90.22
6,067,948 * 5/2000 Kreuter ..... 123/90.22

* cited by examiner

*Primary Examiner*—Teresa Walberg
*Assistant Examiner*—Vinod D. Patel
(74) *Attorney, Agent, or Firm*—Robert W. Becker & Associates

(57) ABSTRACT

A device for activating and deactivating a load change valve of an internal combustion engine has a camshaft with at least one valve cam and at least one coupling cam. A rocker arm is supported on a stationary engine component and has a sensing member riding on the cam and actuating the load change valve. A coupling lever is movably connected to the rocker arm and is acted on by the coupling cam such that the coupling lever is moved relative to the rocker arm. A coupling device is provided for interrupting movement transmission of the sensing member onto the load change valve. The coupling lever cooperates with the coupling device and the coupling cam such that, when the sensing member rides on a base circle of the valve cam, a movement transmission between the sensing member and the load change valve is at least approximately interrupted. A catch device for securing the coupling lever upon its deflection by the coupling cam is provided for interrupting the movement transmission between the sensing member and the load change valve. The coupling device has a positive locking engagement between the sensing member and the rocker arm, which may be released when the coupling lever is secured by the catch device such that the sensing member is moved by the valve cam relative to the rocker arm.

11 Claims, 8 Drawing Sheets

DEVICE FOR ACTIVATING AND DEACTIVATING A LOAD CHANGE VALVE OF AN INTERNAL COMBUSTION ENGINE

BACKGROUND OF THE INVENTION

The present invention relates to a device for activating and deactivating a load change valve of an internal combustion engine.

The reduction of fuel consumption has recently become more and more important. A possibility to achieve this temporary deactivation of individual cylinders for an engine having multiple cylinders so that the remaining cylinders will operate at higher medium pressure and thus at a reduced specific fuel consumption. For deactivating the cylinder it is not only required to interrupt the fuel supply. Expediently, the load flow through the corresponding cylinders is also interrupted by deactivating the load change valves, especially the intake valves, of a respective cylinder.

A device of the aforementioned kind is disclosed in German Patent application 197 49 124.3, unpublished as of the filing of the instant German priority application. In this device of the aforementioned kind an actuating member is movably guided within the rocker arm in addition to a coupling device, whereby the actuating member actuates the valve. This actuating member is selectively coupled by the coupling device rigidly to the rocker arm or is released for a movement relative to the rocker arm for deactivating the valve.

It is an object of the present invention to embody a device of the aforementioned kind such that its design and construction is simplified.

SUMMARY OF THE INVENTION

In the inventive device the sensing member is movable relative to the rocker arm when the load change valve is deactivated, whereby the rocker arm is advantageously embodied as a drag lever. The rocker arm, when the valve is switched off, (deactivated), i.e., respectively, when the positive-locking engagement between the sensing member and the rocker arm is released, remains at rest and only the sensing member is moved by the valve cam.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 8.

In the enclosed drawings, FIGS. 1 through 4 show the inventive device in four different views.

Figure 1:
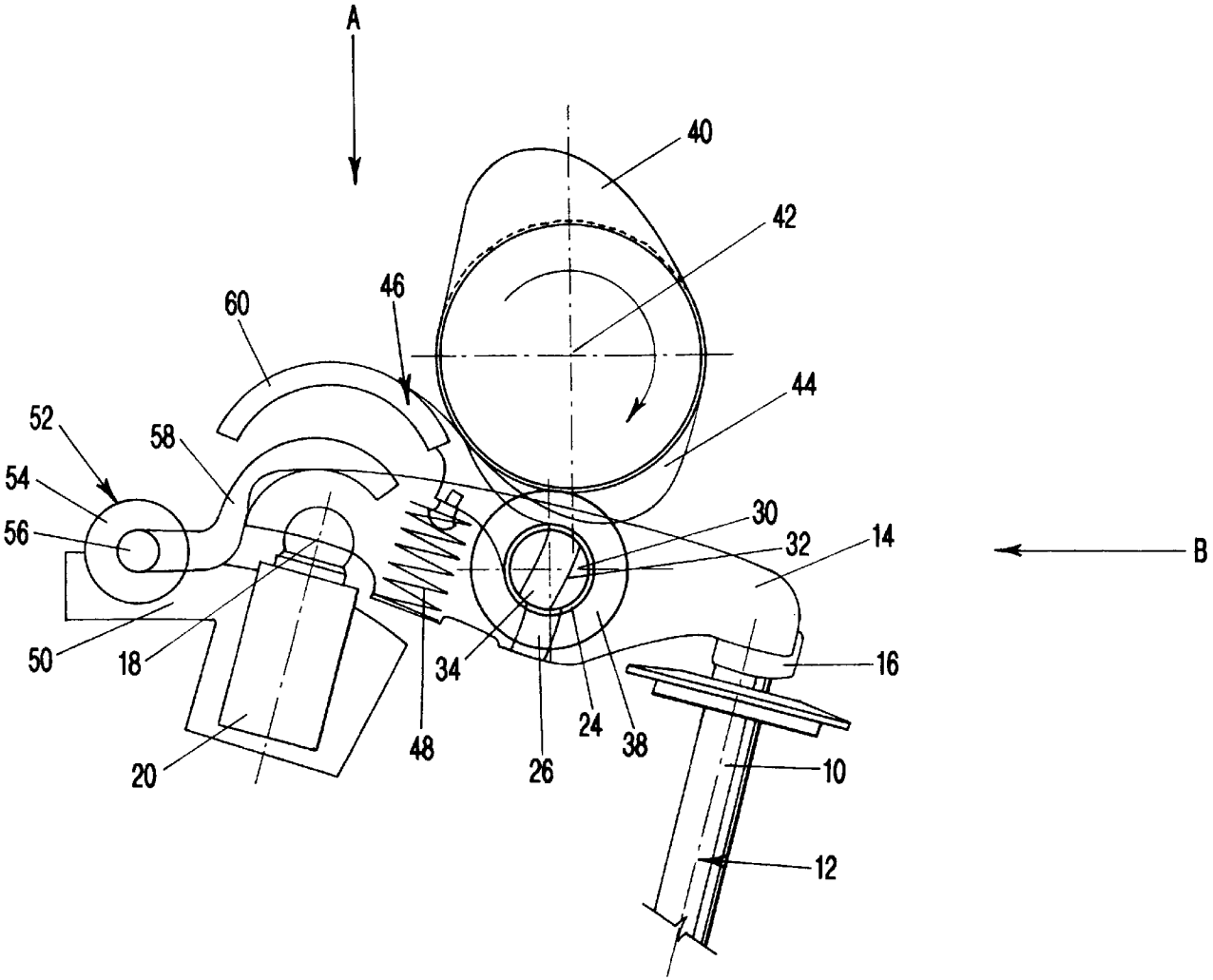
FIG. 1 shows a cross-section of the inventive device.

According to FIG. 1, the valve stem 10 of an intake valve 12, which is not completely represented, of a combustion engine is actuated by a rocker arm 14 which is embodied as a drag lever. For a wear-resistant and friction reduced actuation, the rocker arm 14 has a spherical surface 16 resting on the end face of the valve stem 10.

A closing spring (not represented) will force the intake valve 12 into its closed position.

The rock arm 14 is supported on a spherical segment 18 which is provided at a hydraulic lifter 20 which is fastened to a stationary engine component such as the non-represented cylinder head of the internal combustion engine. The basic construction of such a hydraulic lifter 20 is known. It pushes the spherical segment 18 by a predetermined force in the upward direction upon loading with oil pressure, see FIG. 1.

The rocker arm 14 has a transverse bore 24 from which, according to FIG. 1, a slot 26 extends in the downward direction having a width that is smaller than the diameter of the bore 24.

A guide element 30 is supported in the bore 24 and has an outer diameter which matches the inner diameter of the bore, whereby the guide element 30 has a diagonal groove or diagonal slot 32 in which a flattened portion of a shaft (not represented in FIG. 1) is received on which a roller 38 is supported.

The roller 38 forms a sensing member for sensing the valve cam 40 of a camshaft 42 which has in an area substantially opposite the valve cam 40 a further coupling cam 44 which is axially staggered relative to the valve cam 40.

The coupling cam 44 actuates a coupling lever 46 which is connected rigidly to the shaft having the flattened portion 34 and supporting the roller 38.

Between the rocker arm 14 and the coupling shaft a return spring 48 is positioned which prestresses the coupling lever 46 in the direction toward the camshaft 42.

A solenoid 52 is fastened to the engine or its cylinder head 50 and comprises a coil 54 with a core 56. The core 56 ends in two spaced apart arms 58 having ends that are concentrically curved relative to the spherical segment 18. The end portion 60 of the rocker arm 14 is comprised of a magnetizable material and is approximately concentric to the arms 58. It covers the arms 58 to form the armature of the solenoid 52.

Figure 2:
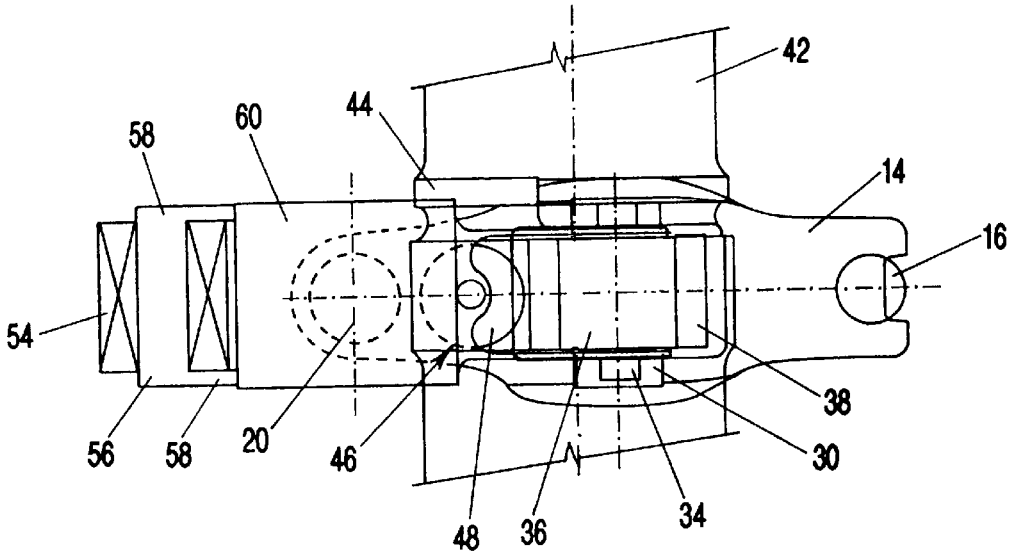
FIG. 2 shows a view of the device in the direction of arrow of A of FIG. 1.

FIG. 2 shows the arrangement according to FIG. 1 in a view in the direction of arrow A in FIG. 1. The camshaft 42 is partly removed from this view. The shaft 36 can now be seen with is flattened portion 34 and the guide element 33 as well as the coupling cam 44 which is arranged axially external to the valve cam 40 (FIG. 1) and cooperates with the coupling lever 46. Instead of one coupling cam 44, it is also possible to provide two such coupling cams 44 symmetrically to the shaft 36 or the roller 38. Also visible is the end portion 60 of the coupling lever 46 which overlaps the arms 58 of the core 56.

Figure 3:
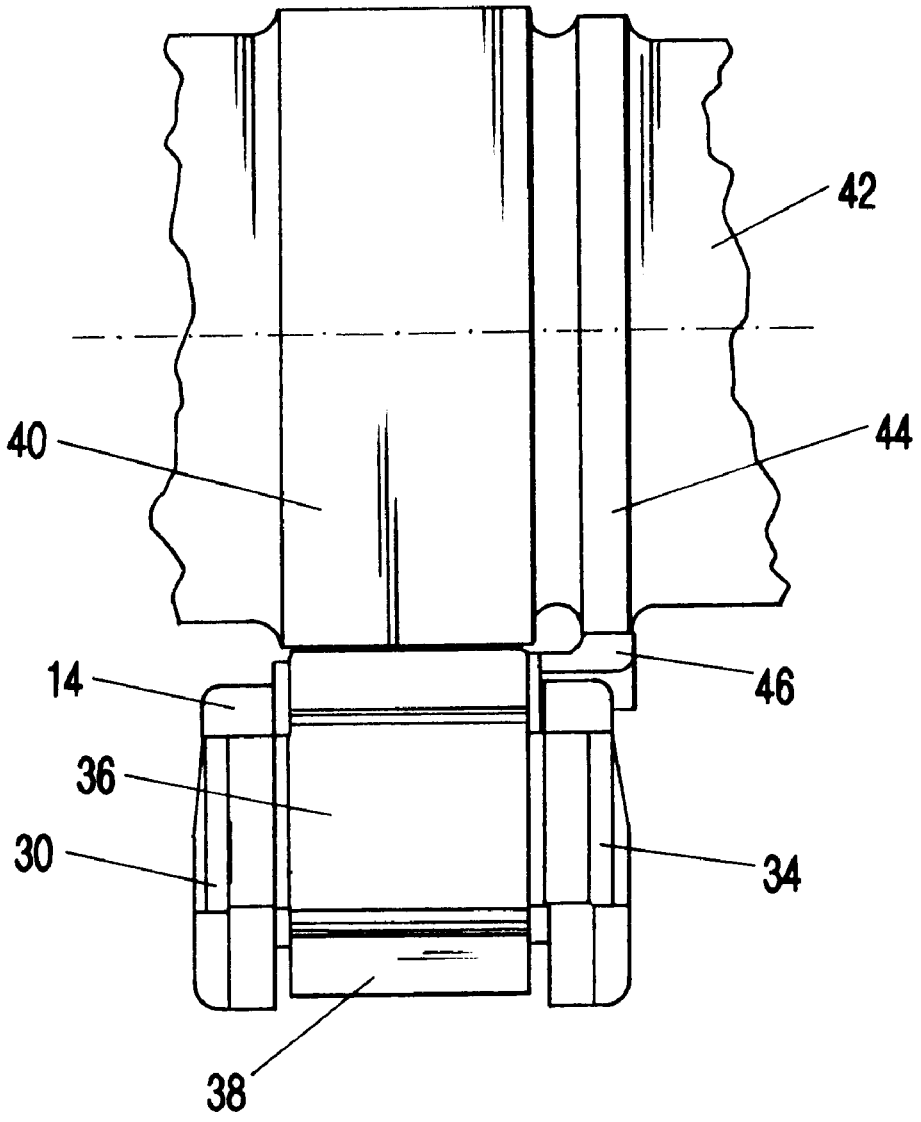
FIG. 3 shows a view of the device in the direction of arrow B of FIG. 1.

FIG. 3 shows the arrangement of FIG. 1, viewed in the direction of arrow B in FIG. 1.

In the following, the operation of the disclosed device is explained.

In FIG. 1 the camshaft 42 is in a position in which the roller 38 rests at the base circle of the camshaft, i.e., the valve 12 is closed. The coupling lever 46 also rests at the base circle of the coupling cam 44 of the camshaft 42 so that the flattened portion 34 is pivoted relative to the slot 26 and the flattened portion 44 and thus the shaft 36, on which the roller 38 is supported, are positive-lockingly connected to the rocker arm 14

Upon further rotation of the camshaft 42, the coupling lever 46 is pivoted by the coupling cam 44 in a counter-clockwise direction so that the flattened portion 34, with simultaneous rotation of the guide element 30, will be aligned with the slot 26 so that the flattened portion 34 could be moved into the slot 26.

The end portion 60 of the coupling lever 46 is formed such that upon pivoting to the full extent by the coupling cam 44 it will be in at least approximate surface contact at the arms 58 of the core 56 of the solenoid 52.

While the coupling cam 44 rides on the coupling lever 46, the roller 38 remains in contact at the base circle of the camshaft 42.

Figure 4:
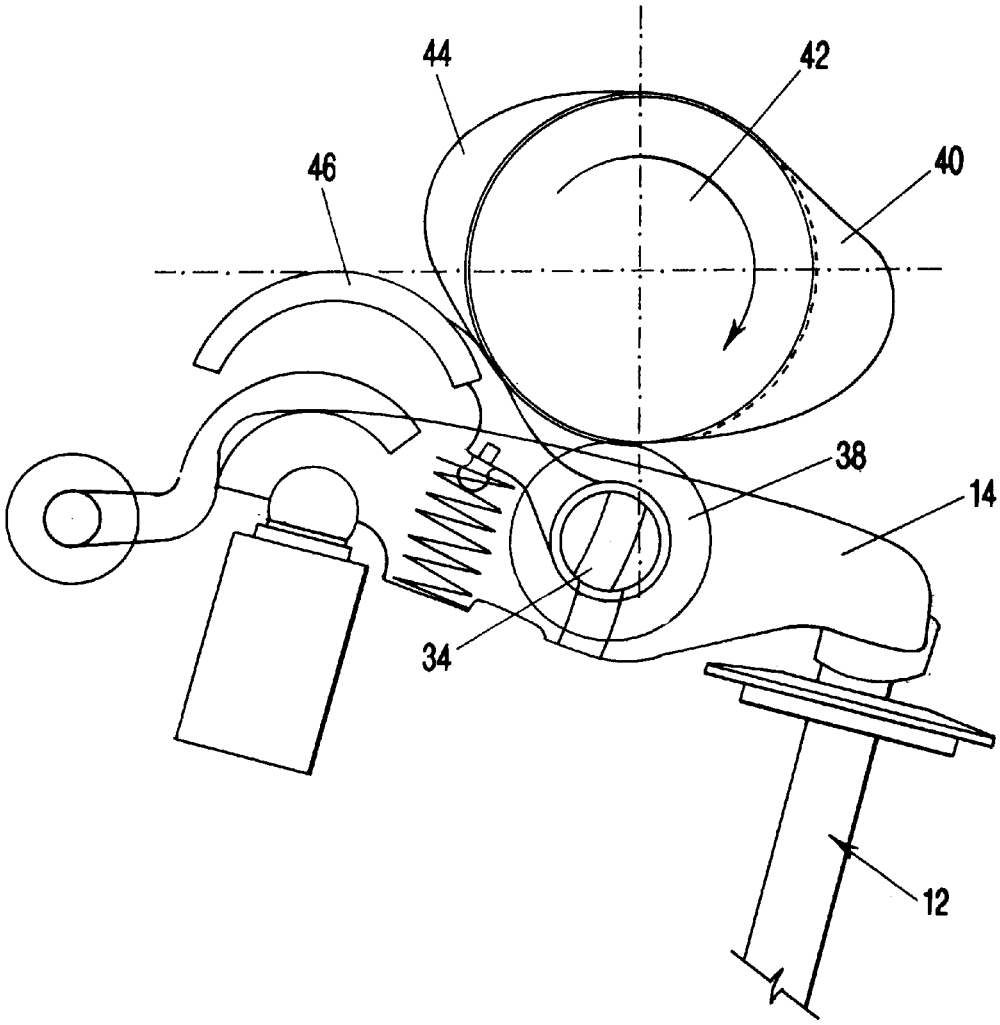
FIG. 4 shows in a view similar to FIG. 1 a first operational position of the device.

Upon further rotation of the camshaft 42 (FIG. 4), the coupling cam 44 will lose contact with the coupling lever 46 so that the flattened portion 34 together with the coupling lever 46 is returned in order to again be positive-lockingly engaged at the rocker arm 14 (FIG. 4). Upon further rotation of the camshaft 42, the valve cam 40 will contact the roller 38 so that the roller 38 will be pushed downwardly so that the rocker arm 14 is pivoted in the clockwise direction in order to open the valve 12.

Upon further rotation of the camshaft 42, the roller 38 will again contact the base circle of the camshaft 42 so that the valve 12 will close. When rotating the camshaft 42 further, the coupling lever 46 is again pivoted by the coupling cam 44 so that the engagement between the roller 38 and the rocker arm 14 is released for a short period of time while the valve is closed.

Figure 5:
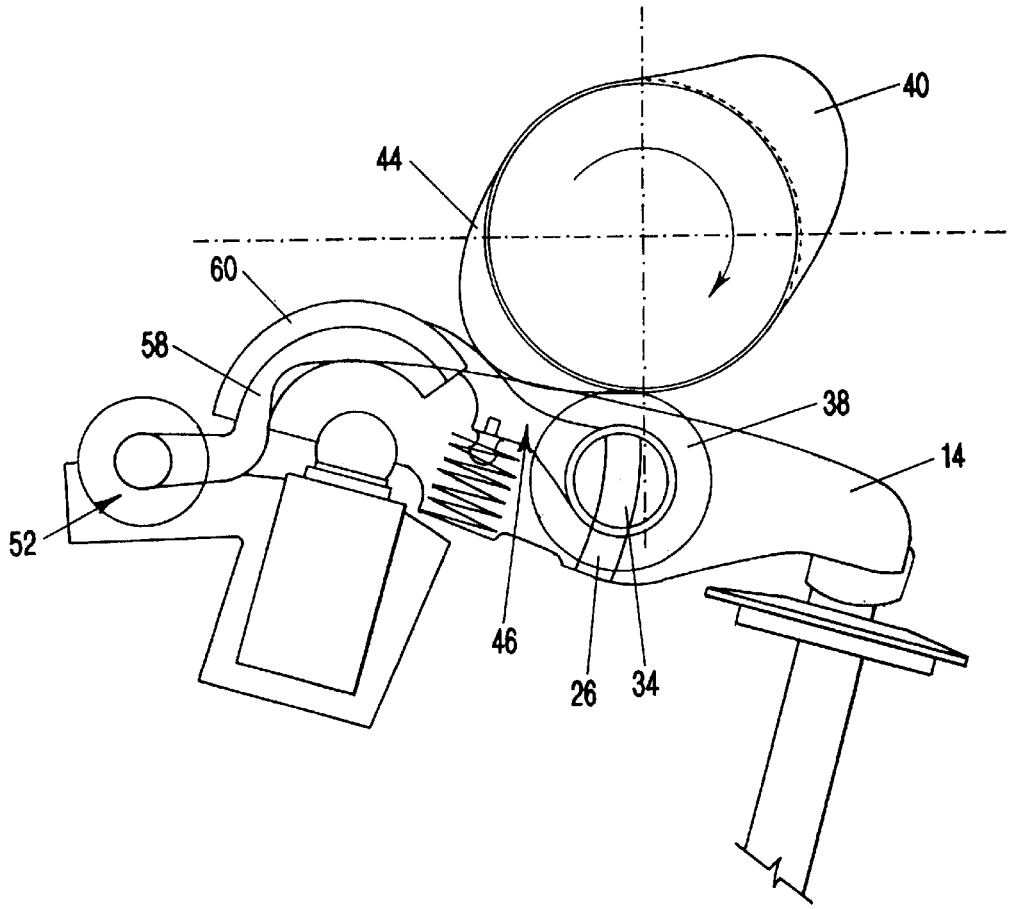
FIG. 5 shows in view similar to FIG. 1 a second operational of the device.
Figure 6:
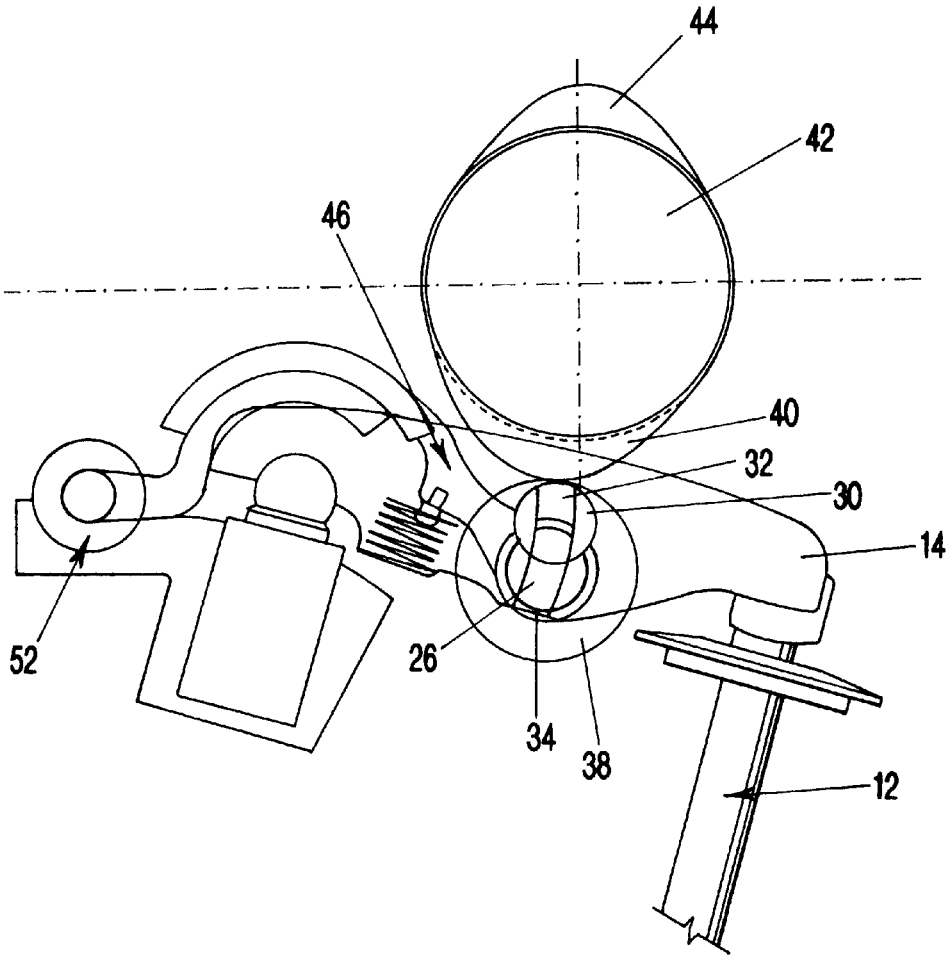
FIG. 6 shows in view similar to FIG. 1 a third operational position of the device.

FIG. 5 shows the state in which the solenoid 52 is activated with the coupling lever 46 is pivoted by the coupling cam 44 in the counter-clockwise direction and the end portion 60 of the coupling lever 46 thus comes close to the arms 58 of the solenoid 52. The end portion 60 acting as an armature is then pulled into contact at the stationary arms 58 of the solenoid 52 so that the flattened portion 34 of the shaft 36 supporting the roller 38 is aligned with the slot 26 and the positive-locking connection between the flattened portion 34 and the rocker arm 14 is canceled. According to the relative arrangement of the valve cam 40 and the coupling cam 44, the above disclosed process is carried out when the valve is closed, i.e., when the roller 38 is substantially free of any force.

When the camshaft 42 is rotated further (FIG. 6) and the valve cam 40 forces the roller 38 in the downward direction, the flattened portion 34 is moved out of the slot 32 of the guide element 30 into the slot 26 of the rocker arm 14 without entraining the rocker arm 14. The valve 12 remains closed.

The decoupling between roller 38 and rocker arm 14 remains in place as long as the coupling lever 46 is secured by the solenoid 52.

When the solenoid 52 is deactivated, as soon as the valve cam 40 has passed the roller 38 completely and the coupling cam 44 contacts the coupling lever 46, the coupling lever 46 will follow the coupling cam 44 and, upon rotation in the clockwise direction, will contact the base circle of the coupling cam 44 of the camshaft 42 so that positive-locking engagement between the flattened portion 34 and the rocker arm 14 is again realized.

As can be seen from the above, with the afore disclosed device it is possible, with minimal energy expenditure of the solenoid 52, and synchronous to the rotation of the camshaft 42, to always deactivate the valve 12 at the time when the solenoid 52 is activated with the end portion 60 of the coupling lever 46 positioned in its vicinity. The activation of the solenoid 52 is carried out by a control device advantageously in the phase in which the valve 12 is completely closed, i.e., while the roller 38 rests at the base circle of the valve cam 40, where the solenoid is activated already before the point in time at which the coupling lever 46 is pivoted to the maximum extent in the counter-clockwise direction.

The deactivation of the solenoid is carried out advantageously at the point in time at which the maximum height of the coupling cam 44 passes the coupling lever 46.

The return spring 48 has the task to secure the coupling lever in constant contact at the camshaft 42 when the solenoid 52 is not excited. The hydraulic lifter 20 ensures that the roller 38 is always in constant contact at the camshaft 42 and the spherical surface 16 of the rocker arm 14 is in constant contact at the valve stem 10 of the valve 12.

When the coupling lever 46 is secured or locked by the solenoid 50, the return spring 48 will force the coupling lever 46, whose end portion 52 is supported at the solenoid 50, in the counter-clockwise direction constantly, so that the shaft 36, which is rigidly connected to the coupling lever 46, is provided with a flattened portion 34, and supports the roller 38, will be forced upwardly (see FIG. 4) and the roller 38 will be maintained in contact at the camshaft 42. By means of the hydraulic lift 20 and the return spring 48, the spherical surface 16 of the coupling lever 46, even for the locked coupling lever 46, remains in constant contact at the valve stem 10 of the valve 12.

The return spring 48 thus has a triple function:

- it provides a force connection between the coupling lever 46 and the coupling cam 44;
- it provides a force connection between the roller 38 and the valve cam 40 when the valve 12 is deactivated, respectively, the coupling lever 46 is secured or locked;
- it provides, when the solenoid 52 is activated, i.e., the coupling lever 46 is secured thereat, that the hydraulic lifter 20 cannot be pumped (lifted) because it is loaded by the reaction force of the rocker arm 14.

As can be seen most clearly in FIG. 4, the slots 26 and 32 as well as the flattened portion 34 are provided with curved lateral surfaces having a curvature center point corresponding approximately to the center point of the spherical segment 18 and thus the bearing axis of the rocker arm 14.

The invention can be adapted in many ways. For example, the coupling lever 46 can also be rigidly connected to the guide element 30 whereby however separate measures must be undertaken so that the shaft 36 of the roller 38 riding on the camshaft will be forced upwardly. The magnetic securing or locking device (catch device) can be replaced by a catch device having a mechanical locking member. The roller can also be replaced by a sensing member of a different design which is movable relative to the rocker arm, etc.

The inventive device operates reliably and is operative with a comparatively weak solenoid and minimal energy expenditure because the activation and deactivation of the valve 12 is carried out, respectively, in its closed state and with the coupling lever 46 being forced by the coupling cam 44 substantially approximately into abutment at the solenoid 50.

Figure 7:
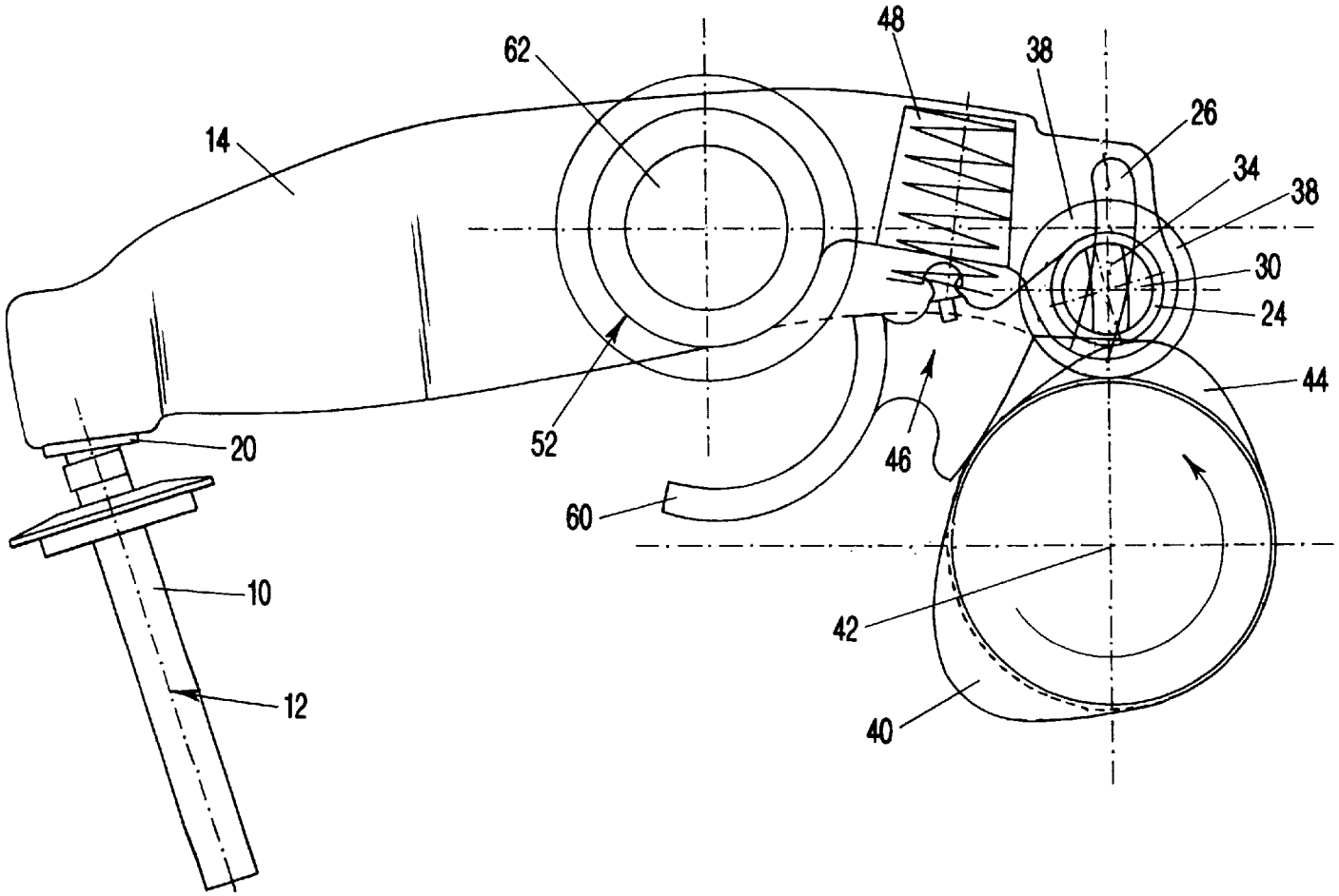
FIG. 7 shows a cross-section of a further embodiment of the inventive device.

FIG. 7 shows an embodiment changed relative to FIG. 1, whereby the same functional state is shown, i.e., the beginning of the phase where the coupling cam will ride on the coupling lever whereby the movement transmission between the valve cam and the valve is realized. Functionally identical components are identified with identical reference numerals.

The primary difference to the embodiment according to FIG. 1 is that the rocker arm 14 is embodied as a pivot lever which is supported on a shaft 52 mounted on the engine and that the hydraulic lifter 20 is positioned between the rocker arm 14 and the valve stem 10 of the valve 12. The pole arms of the solenoid 52 are arranged coaxially to the shaft 62, whereby the arms are provided for securing or locking the end portion 60 of the coupling lever 46. In the same manner as disclosed in regard to the embodiment of FIG. 1, the coupling lever 46 is rigidly connected to a shaft (not identified) which is provided with flattened portions 34 and is supported in the transverse bore 24 of the rocker arm 14. In the same manner as disclosed in connection with the embodiment of the FIG. 1, the flattened portions 34 are received in slots or grooves which are embodied in the guide element 30 received in the transverse bore 24. When the coupling lever 46 is secured by the solenoid 52, the flattened portions 34 can move into the slot 26 of the rocker arm 14, whereby the slot 26 extends away from the transverse bore 24. The shaft provided with the flattened portions 34 supports the roller 38 which functions as a sensing member and rides on the valve cam 40 of the camshaft 42. The coupling cam 44 of the camshaft 42 cooperates with the coupling lever 46. Between the coupling lever 46 and the rocker arm 14 a return spring 48 is arranged which has the same functions as the one disclosed in the connection with the embodiment of FIG. 1. In the case of interrupted positive-locking or force-locking engagement between the rocker arm 14 and the valve cam 40 it will exert a moment in the counter-clockwise direction onto the rocker arm 14 by being supported at the coupling lever 46. This has the effect hat the hydraulic lifter 20 cannot be pumped (lifted).

The functional states of the device according to FIG. 7 correspond to that of the device according to FIG. 1.

Figure 8:
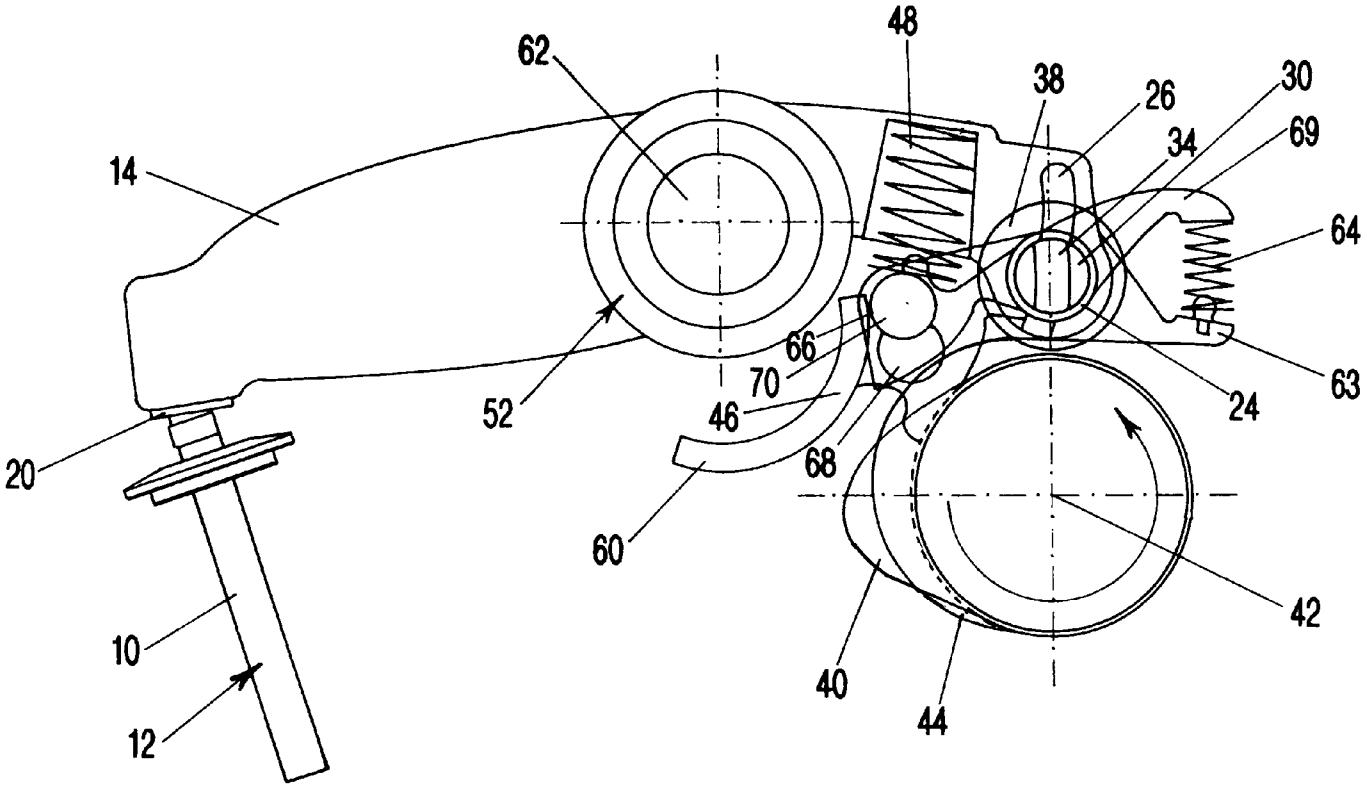
FIG. 8 shows a cross-section of a variation of the embodiment according to FIG. 7

FIG. 8 shows another embodiment as a variation of FIG. 7. The embodiment according to FIG. 8 differs from that of FIG. 7 primarily in that the movement transmission between the coupling lever 46 and the coupling cam 44 can be interrupted. For this purpose, a control lever 69 is coaxially supported at the rocker arm 14 relative to the coupling lever 46. It is prestressed by a spring 64 in a counter-clockwise direction, whereby the spring is positioned on an extension 63 of the rocker arm 14. This has the effect that the sensing surface of the control lever 69 is secured in constant contact at the coupling cam 44.

The coupling lever 46 is maintained by the return spring 48 in constant contact at the base circle of the camshaft 42.

The control lever 69 and the coupling lever 46 are provided with bores 66 and 68 such that the bores 66 and 68 are aligned with one another when the control lever 69 is in contact at the base circle of the coupling cam 44. FIG. 8 represents an operational state in which the control lever 69 rests at the maximum height of the coupling cam 44 and is pivoted to the maximum extent in the clockwise direction.

In the control lever 69 a bolt 70 is received which can be inserted by an electric or hydraulically operating device into the bores 66 and 68 of the control lever 60, when they are aligned, so that the control lever 69 and the coupling lever 46 are fixedly connected to one another.

As can be seen from the above disclosed, the coupling lever 46 will not be pivoted when the bolt 70 is not within the bore 68 so that the positive-locking engagement between the flattened portion 34 and the rocker arm 14 is independent of the position of the coupling cam 44 and no relative rotation between the flattened portion 34, respectively, the coupling lever 46 and the rocker arm 14 takes place. When the bolt 70 connects the coupling lever 46 and the control lever 69, the function of the arrangement according to FIG. 8 is identical to that of FIG. 7.

It is understood that for connecting the control lever 69 to the coupling lever 46 different devices are possible, for example, instead of the bolt 70 a pawl can be used which can be actuated from the exterior or interior of the control lever 69 and the coupling lever 46. The control lever 69 also can be replaced by other components for sensing the coupling cam 44. It is important that the movement transmission between the coupling cam 44 and the coupling lever 46 can be interrupted so that the components affecting movement transmission between the valve cam 40 and the rocker arm 14, will not be moved relative to one anther for each revolution of the camshaft 42.

As can be seen further in FIG. 8, the size and position of the coupling cam 44 relative to the control cam 40 is different in comparison to the FIG. 7. The coupling cam 44 of FIG. 8 overlaps the control cam 40 whereby its projection begins already in front of the control cam 40 so that it is ensured that, when the control lever 69 and the coupling lever 46 are connected to one another, the positive-locking engagement between the flattened portion 34 and the transverse bore 24 can be released as long as the roller 38 is positioned at the base circle of the valve cam 40.

The embodiments can also be altered in that one or more coupling cams and one or more control (valve) cams embodied at the camshaft are different and/or that transmission members are provided with which the cam lifting action can be transmitted onto the rocker arm and the coupling lever or the control lever or components functioning in the same manner.

The specification incorporates by reference the disclosure of German priority document 198 28 945.6 of Jun. 29, 1998.

The present invention is, of course, in no way restricted to the specific disclosure of the specification and drawings, but also encompasses any modifications within the scope of the appended claims.

What is claimed is:

1. A device for activating and deactivating a load change valve (12) of an internal combustion engine, said device comprising:

a camshaft (42) having at least one valve cam (40) and at least one coupling cam (44);

a rocker arm (14) supported on stationary engine component;

said rocker arm (14) having a sensing member (38) riding on said valve cam (40) and actuating the load change valve (12);

a coupling lever (46) movably connected to said rocker arm (14);

said coupling cam (44) acting on said coupling lever (46) such that said coupling lever (46) is moved relative to said rocker arm (14);

a coupling device (24, 26, 30, 32) for interrupting transmission of the movement of said sensing member (38) onto the load change valve (12);

said coupling lever (46) cooperating with said coupling device (24, 26, 30, 32) and said coupling cam (44) such that, during a phase when said sensing member (38) rides on a base circle of said valve cam (40), a movement transmission between said sensing member (38) and the load change valve (12) is at least approximately interrupted;

a catch device (50, 52) for securing a portion of said coupling lever (46) upon deflection of said coupling lever (46) by said coupling cam (44) and interrupting a movement transmission between said sensing member (38) and the load change valve (12);

said coupling device (24, 26, 30, 32) comprising a positive locking engagement between said sensing member (8) and said rocker arm (14), wherein said positive locking engagement is disengaged when said coupling lever (46) is secured by said catch device (50, 52) such that said sensing member (38) is moved by said valve cam (40) relative to said rocker arm (14).

2. A device according to claim 1, wherein said sensing member (38) is a roller supported on a shaft (36) having a flattened portion (34), wherein said rocker arm (24) has a slot 26 and wherein said flattened portion (34) engages said slot (26) so as to be movable in said slot (26) when said coupling lever (46) is secured by said catch device (50, 52).

3. A device according to claim 2, wherein said rocker arm (14) has a bore (24) having an axis extending substantially parallel to an axis of said camshaft (42), wherein said slot (26) extends radially outwardly from said bore (24), wherein said slot (26) has a width that is smaller than a diameter of said bore (24), wherein a guide element (30) is rotatably mounted in said bore (24) and has an outer diameter matching said diameter of said bore (24), wherein said guide element (30) has a slot (32) having a shape matching a shape of said flattened portion (34) of said shaft (36), wherein, when said coupling lever (46) is secured by said catch device (50, 52), said slot (32) of said guide element (30) and said flattened portion (34) are aligned with said slot (24) of said rocker arm (14) and, when said coupling lever (46) is released by said catch device (50, 52), said slot (32) of said guide element (30) and said flattened portion (34) are pivoted relative to said slot (24) of said rocker arm (14) so that a coupling action between said shaft (36) and said rocker arm (24) is realized.

4. A device according to claim 3, wherein said coupling lever (46) is fixedly connected to said shaft (36).

5. A device according to claim 3, wherein said coupling lever (46) is fixedly connected to said guide element (30).

6. A device according to claim 1, wherein said catch device (50, 52) comprises a solenoid (50) connected to a stationary engine component in the vicinity of a support (18) of said rocker arm (14) and wherein said coupling lever (46) has an end portion (52) comprised of a magnetizable material, wherein said solenoid (5) and said end portion (52) cooperated with one another.

7. A device according to claim 1, further comprising a hydraulic lifter (20) fastened to a stationary engine component, wherein said rocker arm (14) is a drag lever resting on said hydraulic lifter (20).

8. A device according to claim 1, further comprising a hydraulic lifter (20), wherein said rocker arm (14) is a pivot lever supported on a stationary engine component and wherein rocker arm (14) actuates the load change valve (12) by having said hydraulic lifter (20) interposed between a point of support at the stationary engine component and the load change valve (12).

9. A device according to claim 1, comprising a return spring (48) positioned between said rocker arm (14) and said coupling lever (46), said return spring (48) forcing said coupling lever (46) against said coupling cam (44) and, when movement transmission between said sensing member (38) and the load change valve (12) is interrupted, said return spring (48) forcing said sensing member (38) against said valve cam (40) and said rocker arm (14) against said hydraulic lifter (20).

10. A device according to claim 1, further comprising a control member (60) sensing said coupling cam (44) and a control coupling device (66, 68, 70), wherein said control member (60) is actuated by said control coupling device (66, 68, 70) so as to engage said coupling lever (46) to provide movement transmission between said coupling cam (44) and said coupling lever (46).

11. A device according to claim 10, wherein said control member (60) is a control lever coaxially arranged to said coupling lever (46), wherein said control lever (60) rests spring-elastically at said coupling cam (44), wherein said coupling lever (46) rests spring-elastically at a base circle of said camshaft (42), and wherein said control coupling device (66, 68, 70) comprises a bolt (70) insertable by an actuating device into bores (66, 68) aligned with one another when said control member (60) rests at said base circle of said coupling cam (44).

* * * * *